United States Patent [19]

Morten

[11] Patent Number: 4,862,038

[45] Date of Patent: Aug. 29, 1989

[54] AUTOMATIC RELAMPING SYSTEM

[76] Inventor: John F. Morten, 11 Glen St., Dover, Mass. 02030

[21] Appl. No.: 59,103

[22] Filed: Jun. 8, 1987

[51] Int. Cl.[4] ..... H05B 39/10

[52] U.S. Cl. ..... 315/86; 315/87; 315/92; 315/88

[58] Field of Search ..... 315/86, 87, 88, 89; 307/92, 90, 70, 64, 69

[56] References Cited

U.S. PATENT DOCUMENTS

| | | | |
|---|---|---|---|
| 3,486,068 | 12/1969 | Dunn et al. | 315/87 |
| 3,693,045 | 9/1972 | Price | 315/87 |
| 4,362,971 | 12/1982 | Sloan, Jr. | 315/86 |
| 4,486,689 | 12/1984 | Davis et al. | 315/88 |
| 4,700,110 | 10/1987 | McNair et al. | 315/87 |
| 4,708,223 | 11/1987 | Orndorff et al. | 315/86 |

FOREIGN PATENT DOCUMENTS

| | | | |
|---|---|---|---|
| 0073575 | 6/1977 | Japan | 315/87 |

*Primary Examiner*—Leo H. Boudreau
*Assistant Examiner*—Michael Razavi
*Attorney, Agent, or Firm*—Wolf, Greenfield & Sacks

[57] ABSTRACT

An automatic relamping system that provides for operation of a single one of multiple illumination lamps with automatic illumination of a next lamp upon failure of an illuminated lamp. A drive circuit is provided for the multiple lamps including an oscillator and means for connecting the multiple lamps in a parallel circuit with the drive circuit. The connections between lamps include direct conductive conductors so that upon starting of any one of the multiple lamps and ignition thereof, the other lamps are inhibited from ignition due to the reduced "on" voltage, in comparison to the "starting" voltage, of the ignited lamp.

8 Claims, 2 Drawing Sheets

AUTOMATIC RELAMPING SYSTEM

BACKGROUND OF THE INVENTION

1. Field of the Invention

The present invention relates in general to lighting or lamp systems and pertains, more particularly, to a lighting system that provides for automatic relamping. The system of the present invention is in particular used for general lighting, corridor lighting, stairway lighting, auxiliary lighting, night lighting and emergency lighting.

2. Background Discussion

In lighting systems, each time that a lamp, such as a fluorescent lamp fails, it is necessary to replace the lamp. This is a time consuming, labor-intensive activity even under the best of circumstances. It is particularly troublesome when the fixture is mounted at ceiling height typical of an office building, say eight to ten feet above the floor. Under these circumstances the relamping cost is typically 70% labor and 30% lamps.

However, when the mounting height of the fixture is greater than this, say 20 feet up to 80 feet or more above the floor, then the labor can become as high as 95% of the cost of relamping. For example, manufacturing buildings, warehouses, auditoriums, theaters, churches, gymnasiums, indoor swimming pools and other sports arenas, atriums, or, in factories where machinery and equipment interfere with access to lighting fixtures—these are all representative of difficult relamping conditions.

Accordingly, it is an object of the present invention to provide an improved lighting system in which relamping occurs automatically, thus essentially eliminating the labor-intensive activities previously referred to.

SUMMARY OF THE INVENTION

In accordance with the invention, there is provided an automatic relamping system that provides for operation of a single one of multiple lamps with automatic illumination of a next lamp upon failure of an illuminated lamp. In this way, the system can be provided with a multiplicity of lamps, but each time that a lamp fails, a new lamp is automatically illuminated and thus there is no need for any lamp replacement labor. There may initially be a cost factor regarding the provision of multiple lamps which must be purchased a number of years prior to their actual use, but the savings due to the elimination of future labor charges can be many-fold greater than the cost of the additional lamp inventory thus tied up.

In accordance with the system of the present invention, there is provided a drive circuit for the multiple lamps. The drive circuit includes an oscillator for providing a predetermined frequency drive signal. Means are provided for connecting the multiple lamps in parallel circuit with the drive circuit. The connections between the lamps are provided by direct conductive conductors so that upon starting of any one of the multiple lamps and ignition thereof, the other lamps are inhibited from ignition once the first-to-start lamp ignites. Once this ignition occurs, then the "on" voltage, in comparison to the "starting" voltage of the ignited lamp is not sufficient to ignite any additional lamps. Furthermore, in one embodiment the power output of the drive circuit is limited, typically to a level sufficient for one lamp only. Upon failure of an illuminated lamp, however, then one of the other, yet-to-be-ignited lamps will ignite.

The multiple lamps each have a slightly different "starting" voltage with the lamp of lowest "starting" voltage being ignited first. Upon successive lamp failures, the subsequent lamps are ignited one at a time usually in an order determined by the "starting" voltage. The lamp illumination occurs in a sequence of increasing "starting" voltage.

The concepts of the present invention apply in, for example, fluorescent lamps, gas discharge lamps, and cold-cathode gas discharge lamps. The principles of the invention also apply in connection with rapid start, instant start, and preheated fluorescent lamps as well as in all forms of gas discharge lamps. Wattages of the lamps can range from a low of 4 watts or less to a high of 1000 watts or more.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Known lighting systems exist in which a plurality of lamps such as fluorescent lamps are connected in parallel and driven from a drive circuit. In this regard, refer to FIG. 1 for an illustration of a drive circuit 10 having its output connected to a plurality of lamps L1–LN. Each of the lamps L1–LN, it is noted, has associated therewith connected in series with each respective lamp, a capacitor, illustrated in FIG. 1 as capacitor C1–CN.

The circuit 10 provides an alternating frequency signal for driving the lamps. In this particular construction, all of the lamps are illuminated as this is the intended objective of the circuit. In other words, the circuit is constructed so that an impedance and in particular a capacitive reactance is coupled in series with each of the lamps. The circuit 10 is designed so that the power output thereof is sufficient for providing drive current to all lamps.

Figure 1:
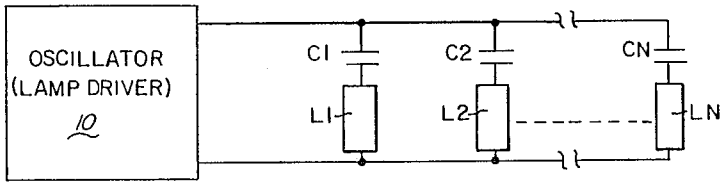
Fig. 1 PRIOR ART
FIG. 1 is a prior art diagram illustrating a lamp drive system for multiple lamps.

In the prior art embodiment of FIG. 1, if a lamp fails, all other lamps are illuminated at the same time and thus nothing occurs in the circuit other than the fact that the failed lamp extinguishes.

For automatic relamping lighting purposes, in particular, a circuit as depicted in FIG. 1 is undesirable because, at least initially, and usually over a relatively long period of time, all of the lamps are operative.

What has been discovered in accordance with the present invention, is that by removing the impedance in series with each of the lamps, capacitor C1–CN from FIG. 1, and preferably limiting the power output thereof to a level sufficient only for one lamp to operate, then only one lamp at a time is ignited. In this regard, refer to FIG. 2. It is noted in FIG. 2 that each of the fluorescent lamps L1–LN has no capacitor or other impedance or energy storage element connected in series therewith. There are other capacitors C3 and C4 in FIG. 2 coupling to the lamps, but these are connected on the input side of the lamps and are essentially in common to all lamps.

Figure 2:
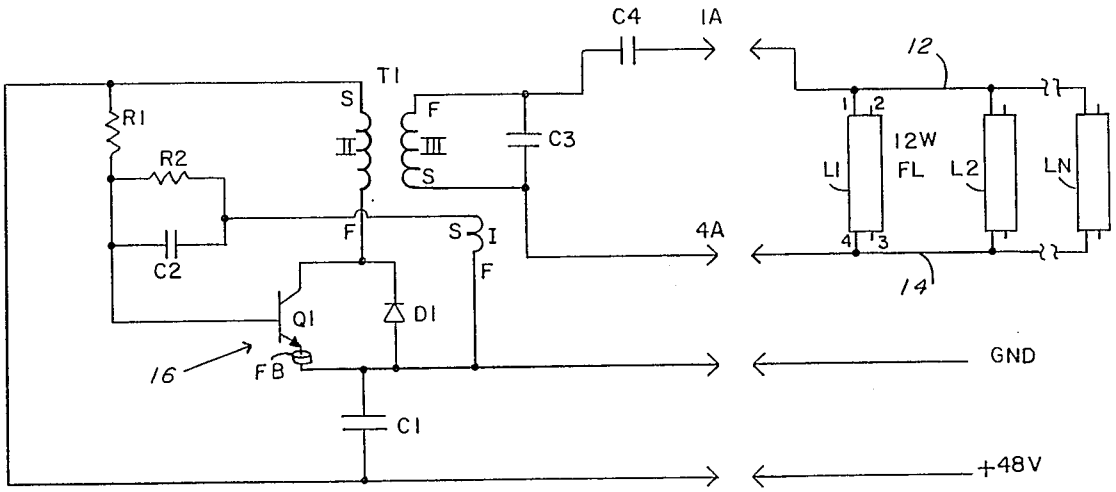
FIG. 2 is a circuit diagram of an automatic relamping system as in accordance with the present invention.
Figure 3:
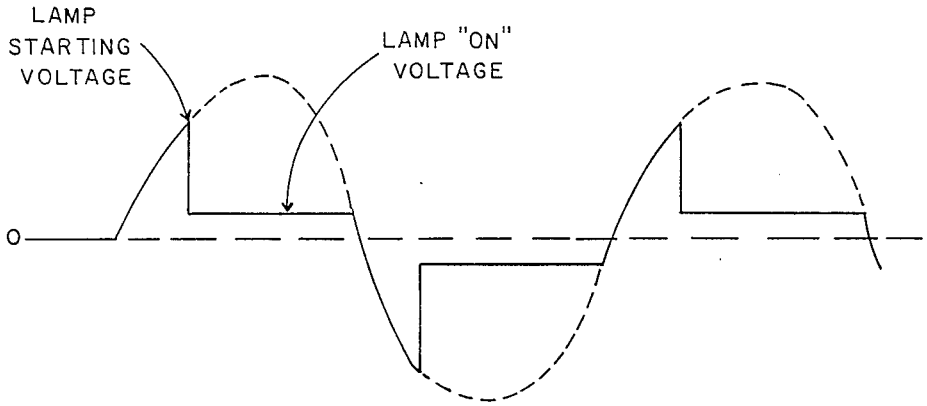
FIG. 3 is a waveform of lamp voltage associated with the circuit of FIG. 2.

Thus, as embodied in a circuit such as found in FIG. 2, each of the lamps is operated with a sinusoidal signal such as illustrated in FIG. 3. However, only one of the lamps is ignited. In this regard, note the transformer T1 and the capacitor C3 and C4 at the output secondary winding III. When a lamp is ignited, then the value of the capacitors C3 and C4 together are chosen so that the current coupled to the lamp is sufficient for basically single lamp illumination.

The primary reason as to why only one lamp at a time ignites, relates to the waveform of FIG. 3. It is noted that each of the lamps L1–LN has a slightly different starting voltage. These starting or striking voltages may be on the order of one thousand volts, but may vary by plus or minus 10%. Note in FIG. 3 the lamp starting voltage point. Also note that the lamp "on" voltage is substantially less. This may be on the order of 57 volts versus the 1000 volts for starting.

Without any impedance in series with any of the lamps, once the power is applied, then only one of the lamps ignites. This theoretically is the lamp with the lowest starting voltage. Once this lamp ignites, the voltage across the lamp reduces immediately to the level indicated in FIG. 3 as an "on" voltage. This has the effect of essentially shorting out the remaining lamps and not permitting ignition thereof. If two lamps have similar "starting" voltages, it is possible that very initially two lamps may start to ignite. However, from experimentation, this condition only appears as a "flickering" and in a steady state condition, what occurs is that only a single lamp at a time will remain ignited.

In the previous circuit described in FIG. 1, all of the lamps are ignited because there is an impedance in series with each of the lamps, and, there is sufficient energy provided to support illumination of all lamps. With the impedance in series with each lamp, this prevents a short-circuit across the other lamps so that all of them can ignite. Even though one of the lamps may start first, even in the embodiment of FIG. 1, the voltage drop enabled across the associated capacitor will maintain the voltage sufficiently high so that other lamps will start. To the human eye, in this circuit of FIG. 1 it appears that all lamps L1–LN start at the same time and remain illuminated.

Again, in accordance with the present invention, by providing a direct conductive connection between lamps, such as by the conductors 12 and 14 in FIG. 2, there is provided a clamping effect which essentially clamps the other lamps "off" when the first lamp has ignited.

Lamp ignition voltage depends upon numerous parameters including the gas pressure and the electron emission properties of the electrodes of the particular lamp. These properties tend to cause the lamp ignition voltage or "starting" voltage to increase with long operating life. The end of life may be considered as reached when the required "starting" voltage exceeds the capability of the ballast. This may be considered herein as a failure. Also, the lamp can also fail for a number of other reasons. Whenever a lamp failure occurs, then the clamping effect is removed and this enables one of the other lamps to then be started. Each time a failure occurs then, a further lamp will automatically be started. There is no intervention that occurs and there is no labor that is required to provide this automatic relamping.

There is little to limit the number of lamps which can be used in this automatic relamping concept except space considerations. One experimental version included 20 F13T5 lamps in an EXIT sign with an estimated life of 30 to 40 years without manual intervention.

It has been found that in operating a circuit such as illustrated in FIG. 2, the gas pressure and emissive properties of the electrodes is enhanced by temperature induced by the discharge. Thus, once a lamp has been ignited, it tends to repeat on every half cycle of the power frequency. Only after an extended period of time when the lamp is worn out does it fail to re-ignite.

As indicated previously, there is a very slight probability that several lamps in a parallel array driven by a common current source may try to be "on" simultaneously. However, it has been found that this potential unstable condition actually is not sustained and in a fraction of a second after perhaps some slight "flickering" only one of the lamps maintains its illumination, with no further flickering of any lamp.

The life of those lamps which are connected but which are not drawing current is not being consumed. The full life of these lamps is available when they come on-line. Shelf life of these lamps is believed to be at least forty to fifty years.

With further reference to FIG. 2, there is shown therein a lamp drive circuit including an oscillator 16 that is comprised of transistor Q1, transformer T1 and associated resistors and capacitors. The primary winding of the transformer T1 couples in series with the transistor Q1. The base of transistor Q1 couples to an RC circuit including resistor R1, resistor R2 and capacitor C2. The capacitor C2 and resistor R2 connect by way of a further winding I of the transformer. Between the emitter and the collector of the transistor Q1 is disposed the diode D1. The input DC which in this instance is 48 volts DC is connected to both capacitor C1 and resistor R1. The input ground is coupled to the opposite side of capacitor C1 as well as to winding I. Experimental versions have been operated at 6, 12, 24 and 48 volts DC and at 120 volts AC. It is believed that higher and lower DC voltages and AC voltages can also be utilized.

The oscillator depicted in FIG. 2 is a 65 KHz oscillator, experimental versions have been operated at 20 KHz and lower, and at 200KHz and higher, for energizing one of a series of either 8 watt or 13 watt volt fluorescent lamps, identified in FIG. 2 as lamps L1–LN. It is noted in FIG. 2 that in the preferred construction, only one of the two bi-pins on each end of the lamp is connected. Thus, the lamp filaments in this particular version are not preheated. A high voltage is employed, such as on the order of at least one kilovolt to start the lamp. Again, refer to the waveform of FIG. 3.

The output from the drive circuit is at the secondary winding III. Coupled across this winding is the capacitor C3. Essentially in series with the secondary of the transformer and the capacitor C, is the other capacitor C4.

It is noted in the circuit of FIG. 2, that although there is a capacitor C4 coupling to lamp L1, there are no further capacitors in the circuit at the lamp end and each of the lamps are in direct conductive connection as indicated by the conductors 12 and 14. If each lamp was connected to the transformer winding with its own impedance, then each lamp could be ignited and would draw current, as illustrated previously in connection with the prior art view of FIG. 1.

The oscillator of FIG. 2 is a blocking oscillator that converts 48 volts DC into a high voltage, constant current AC signal such as illustrated in FIG. 3. At the instant that the 48 volts is applied, a small current flows in winding II of transformer T1. This induces a current in winding I which flows into the emitter of transistor Q1. This causes the collector current of the transistor Q1 to increase. This is a regenerative reaction causing transistor Q1 to switch rapidly into conduction. The drive to the emitter falls off due to the accumulation of charge on capacitor C2 and the collector current levels off. The moment that this current is no longer increasing, the voltages induced in the transformer windings fall, the drive to the emitter of transistor Q1 now switches transistor Q1 out of conduction or "off". The sudden collapse of the magnetic flux in transformer T1 now induces very high volts per turn in each of the windings, which in the case of winding III may be thousands of volts were it not for the action of the lamps and the capacitor C3. A capacitor C3 absorbs the high voltage spike and "rings" with the inductance of winding III to produce an approximation of a sign wave across the parallel combination of winding III and capacitor C3. The frequency of oscillation is determined by the familiar equation:

$$f = \frac{1}{wL_{III}C}$$

where C=C3 when no lamp is energized and C=C3+C4 when one or more lamps are conducting.

The current drawn by the lamp and thus the illumination thereof is proportional to the value of the capacitor C4. In this regard, it is noted that the capacitor C4 may also be replaced by an inductor in which case the lamp current varies inversely with the value of the inductance.

In FIG. 2 the capacitor C1 is a filter capacitor which prevents collector pulse currents from radiating from the 48 volt supply leads. The diode D1 prevents breakdown of the transistor during the high voltages by the magnetic field collapse. The ferrite bead FB coupled to the emitter of transistor of Q1 dampens very high frequency spurious oscillations.

The circuit depicted in FIG. 2 preferably operates at a high frequency. In the circuit of FIG. 2 the frequency of oscillation may be 65 KHz. However, the concepts of the invention also apply at lower operating frequencies and may be even used at frequencies of operation at 60 Hertz.

The concepts of the present invention are adapted for use with the fluorescent lamps as indicated in the drawing. Also, other types of gas discharge lamps may be employed. For example, a cold cathode gas discharge lamp may be used. Such lamps may or may not be preheated.

In association with the circuit of FIG. 2, there is now set forth a listing of more specific values of components along with associated parameters including details of the transformer construction.

C1 2 mfd, 20%, 50 volt+ Polyester Film Capacitor.
C2 0.068 mfd, 10%, 50 volt+ Capacitor.
C3 560 pf, 1000 volt.
C4 330 pf, 10% 1000 volt.
D 1 amp, 200 volt, fast recovery diode; 1N4936.
FB Ferrite Bead, Fair-Rite Products Corp., Wallkill, N.Y. 12589 #267300030.
Q1 General Electric D44Q1 or D44Q2.
R1 12K ohm, 5%, ½ watt composition resistor.
R2 330 ohm, ¼ watt composition resistor.
T1 UDEC Special Transformer on 23/11 (see following specifications.
Core: Ferroxcube Type 2311TS-3C8
Core Gap Spacer: 0.0008".
Bobbin: Ferrocube 2311TB-10.
1st Winding: 2 turns, AWG #32, Teflon insulated wire Beldon #83041 (7×40); Connect Start to Terminal 1 and Finish to Terminal 2.

2nd Winding: 12 Turns AWG 28 Heavy (double) Film; Connect Start to terminal 3 and Finish to terminal 4. Cover coil with 1 wrap of 0.005" Teflon or Polyester tape.

3rd Winding: 156 turns, AWG 32 HF; This is a high voltage coil, do not allow turns of first part of coil to touch turns of last part of coil. Insulate Start lead to its terminal. Connect Start to terminal 5; Finish to terminal 6.

Having now described a limited number of embodiments of the present invention, it is contemplated that additional embodiments and modifications thereof also shall fall under the scope of the present invention as defined by the appended claims.

What is claimed is:

1. An automatic relamping system that provides for operation of a single one of multiple illumination fluorescent lamps with automatic illumination of a next lamp upon failure of an illuminated lamp, said system comprising, a drive circuit for the multiple lamps, said drive circuit including an oscillator for providing a predetermined frequency drive signal, and means connecting said multiple lamps in parallel circuit with said drive circuit and including a reactance means coupled in common with all said lamps, the connection between lamps including direct conductive conductors, whereby, upon starting of any one of said multiple lamps and ignition thereof, the other lamps are inhibited from ignition due to the reduced "on" voltage, in comparison to the "starting" voltage, of the ignited lamp, and whereby, upon failure of an illuminated lamp, one of the other lamps ignites, only one lamp at a time having sustained illumination, said multiple lamps each having a different "starting" voltage, with the lamp of lower "starting" voltage being ignited first, wherein upon successive lamp failures the subsequent lamps are ignited one at a time in an order determined by the "starting" voltage, the lamp illumination sequence being in a sequence of increasing "starting" voltage, and wherein said connecting means in absent any substantial reactance means.

2. An automatic relamping system as set forth in claim 1 wherein said drive circuit further comprises an output capacitor coupled in common with all said lamps.

3. An automatic relamping system as set forth in claim 2 including a step-up transformer having the output capacitor connected in parallel thereacross.

4. An automatic relamping system as set forth in claim 3 including a second capacitor coupled in series between the output capacitor and lamps.

5. An automatic relamping system as set forth in claim 1 wherein the lamps are gas discharge lamps.

6. An automatic relamping system as set forth in claim 1 wherein the lamps are cold-cathode gas discharge lamps.

7. An automatic relamping system as set forth in claim 1 wherein said direct conductive conductors have substantially zero impedance.

8. An automatic relamping system as set forth in claim 1 wherein said drive circuit is designed for power output sufficient for illumination of substantially only one lamp.

* * * * *